US008051894B2

(12) United States Patent
Moon et al.

(10) Patent No.: US 8,051,894 B2
(45) Date of Patent: Nov. 8, 2011

(54) CENTERING SUBMERGED ENTRY NOZZLE FOR CONTINUOUS CASTING OF METAL SLAB

(75) Inventors: Hongkil Moon, Chungcheongnam-do (KR); Kaeyoung Lee, Pyeongtaek-si (KR); Jutae Choi, Seoul (KR); Jaehwan Ahn, Chungcheongnam-do (KR); Hyojoong Kwon, Gwangju-si (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 12/602,766

(22) PCT Filed: Feb. 20, 2009

(86) PCT No.: PCT/KR2009/000802
§ 371 (c)(1),
(2), (4) Date: Dec. 2, 2009

(87) PCT Pub. No.: WO2009/157638
PCT Pub. Date: Dec. 30, 2009

(65) Prior Publication Data

US 2011/0127002 A1 Jun. 2, 2011

(30) Foreign Application Priority Data

Jun. 26, 2008 (KR) ..... 10-2008-0061199

(51) Int. Cl.
*B22D 11/16* (2006.01)
*B22D 41/56* (2006.01)

(52) U.S. Cl. ..... 164/452; 164/154.5; 164/488; 164/437

(58) Field of Classification Search ..... 164/452, 164/453, 154.5, 488, 437
See application file for complete search history.

(56) References Cited

U.S. PATENT DOCUMENTS 4,909,302 A * 3/1990 Takahashi et al. ..... 164/154.3

FOREIGN PATENT DOCUMENTS

JP 03-099759 A 4/1991
JP 04-187353 A 7/1992

(Continued)

OTHER PUBLICATIONS

Supplementary European Search Report dated Feb. 8, 2011 in European Application No. EP 09 75 6645 (5 pages).
International Search Report dated Oct. 1, 2009 in International Application No. PCT/KR2009/000802 (3 pages).

(Continued)

*Primary Examiner* — Kevin P Kerns
(74) *Attorney, Agent, or Firm* — Knobbe Martens Olson & Bear LLP

(57) ABSTRACT

The present invention relates to an apparatus for centering a submerged entry nozzle. The present invention includes: a plurality of laser beam generators 20 that is disposed above a mold 3 for continuous casting to radiate a laser beam toward the center of the mold; a tundish moving unit 15 that moves a tundish 1 above the mold 3; and a control unit that is linked with the laser beam generators 20 and controls the tundish moving unit 15 to center the installation position of the submerged entry nozzle 5 provided at the lower portion of the tundish, in response to signals transmitted from the laser beam generators 20. According to the present invention, in addition to accurately and quickly centering the submerged entry nozzle 5, it is possible to maintain the submerged entry nozzle that has been centered, such that it is possible to minimize a channeling phenomenon of molten steel. Accordingly, it can be expected to improve the quality of a slab.

14 Claims, 4 Drawing Sheets

FOREIGN PATENT DOCUMENTS

| | | | |
|---|---|---|---|
| KR | 10-1992-0008556 | B1 | 10/1992 |
| KR | 20-0152852 | Y1 | 8/1999 |
| KR | 20-2001-0001713 | U | 1/2001 |
| KR | 10-2005-093483 | A | 9/2005 |
| KR | 10-0653533 | B1 | 12/2006 |

OTHER PUBLICATIONS

Written Opinion dated Oct. 1, 2009 in International Application No. PCT/KR2009/000802 (3 pages).

* cited by examiner (a)

(b)

CENTERING SUBMERGED ENTRY NOZZLE FOR CONTINUOUS CASTING OF METAL SLAB

TECHNICAL FIELD

The present invention relates to an apparatus for centering a submerged entry nozzle, in more detail, an apparatus for centering a submerged entry nozzle which can accurately measure and manage the centering position of a submerged entry nozzle that is used to supply molten steel from a tundish into a mold.

BACKGROUND ART

A continuous casting process produces a slab by continuously supplying molten steel from a ladle to a mold while temporarily storing the molten steel in a tundish of a continuous caster and cooling the mold.

FIG. 1 is a cross-sectional view illustrating examples of incorrect positioning of a submerged entry nozzle that is inserted down into a mold, and FIG. 2 shows graphs illustrating the result of a numerical analysis of normal or abnormal channelling phenomenon of molten steel according to the positioning of a submerged entry nozzle.

According to the figures, a submerged entry nozzle 5 that supplies molten steel into a mold 3 is mounted under the tundish 1. The submerged entry nozzle 5 is mounted to penetrate and extend out from the bottom of the tundish 1 while passing through a well block 7, which is inserted through the bottom of the tundish 1, and a nozzle connector 9 attached to the bottom. The nozzle connector 9 holds the upper portion of the submerged entry nozzle 5 to maintain the perpendicularity of the submerged entry nozzle.

Two opposing molten steel discharge holes 11 are formed at a lower portion of the submerged entry nozzle 5. A stopper 13 is disposed over the submerged entry nozzle 5, which controls the amount of supply of molten steel into the mold 3 by opening/closing the submerged entry nozzle 5.

Installation of the tundish 1 having this configuration is completed by inserting the submerged nozzle 5 down into the mold 3 and positioning the lower end of the submerged entry nozzle 5 inside the mold 3, in which a centering operation of the submerged entry nozzle 5 is performed.

The centering operation of the submerged entry nozzle 5 is performed by moving the tundish 1, using a cylinder, in which the quality of a product is largely influenced by design factors, such as the shape, size, and position (submerged depth) of a molten steel discharge hole, and operational factors, such as the initial installation position before casting starts and a position change generated in casting.

That is, when the submerged entry nozzle 5 is accurately centered, as shown in FIG. 2A, a left-right symmetric flow pattern is formed in the long side (defining the width of billet) and short side (defining the thickness of billet) directions of the mold 3 and consistent initial solidification is ensured, such that it is possible to manufacture a fine billet or a defect-free billet.

However, thermal deformation in the longitudinal direction of the mold 3 is easily generated when the tundish 1 is used over a long period of time, and as a result, the tundish 1 becomes eccentric at one side in the longitudinal direction. The eccentricity of the tundish 1 reduces the accuracy for centering the submerged entry nozzle 5 in the mold 3, even if the submerged entry nozzle 5 is installed perpendicular at the lower portion of the tundish 1.

As described above, when casting is performed by opening the stopper 13, with the submerged entry nozzle 5 inaccurately centered, as shown in FIGS. 2B and 2C, the molten steel becomes concentrated at one side within the mold 3, thereby generating a channelling phenomenon of the molten steel.

The channelling of the molten steel is closely related to the error in the installation position of the submerged entry nozzle 5, and the installation position error of the submerged entry nozzle 5 is caused mainly by off-centering that occurs in actual continuous casting. Examples of the off-centering are as follows.

There are some cases, such as, first, when the center of the submerged entry nozzle 5 deviates from the center of the mold 3 to the left direction of FIG. 1A, second, when it deviates from the center to the right direction of FIG. 1B, and third, when the submerged entry nozzle 5 is tilted at an angle as in FIG. 1C, which may be caused by inaccurate connection of the nozzle connector 3 or its rotation during changing the submerged entry nozzles 5.

The channelling of the molten steel S inside the mold by the off-centering causes an increase in the fluctuation of the surface of the molten steel or vortex, such that mold powder becomes entrapped in the molten steel S, thereby causing non-uniform solidification. The non-uniform solidification generates non-uniform solidified shells and deteriorates the quality of a slab, and if excessive, it causes a break-out in which the billet explodes and the molten steel flows out during casting.

The break-out increases the possibility of a safety accident to workers and damage to the equipment. Further, as the equipment is damaged, the entire operation should be stopped and the operation equipment should be reset, thereby reducing manufacturing efficiency.

Technical Problem

In order to remove the problems in the related art, it is an object of the present invention to provide an apparatus for centering a submerged entry nozzle that can measure the installation position of a submerged entry nozzle and automatically center a submerged entry nozzle on the basis of the measured result to minimize channelling of molten steel caused by an error in the installation position of the submerged entry nozzle.

Technical Solution

In order to achieve the objects of the present invention, an apparatus for centering a submerged entry nozzle according to the present invention includes: a plurality of laser beam generators that is disposed above a mold for continuous casting to radiate a laser beam toward the center of the mold; a tundish moving unit that moves a tundish above the mold; and a control unit that is linked with the laser beam generators and controls the operation of the tundish moving unit to center the installation position of the submerged entry nozzle provided at the lower portion of the tundish, in response to signals transmitted from the laser beam generators.

The laser beam generator includes: a first laser beam generator and a second laser beam generator that are disposed apart from each other in the up-down direction above the mold and radiate parallel laser beams toward a vertical axis passing through the center of the mold; and a third laser beam generator that is disposed above the mold and radiates a laser beam that meets the laser beam radiated from one of the first laser beam generator and the second laser beam generator.

The tundish moving unit includes: a car body where the tundish is seated; a car actuating mechanism that is provided at both sides of the car body and horizontally moves the tundish above the mold; and a plurality of lifters that is disposed on the car body and adjusts inclination of the seated tundish while supporting the lower portion of the tundish.

The lifter has a seating protrusion that protrudes above the car body and an adjusting protrusion that can be moved up/down on the seating protrusion and supports the lower portion of the tundish with the upper end.

The control unit measures the lengths of a plurality of laser beams radiated from the laser beam generators and selectively drives any one of the car actuating mechanism and the lifter on the basis of the measured result.

The control unit measures the lengths of a plurality of laser beams radiated from the laser beam generators and drives the car actuating mechanism and the lifter on the basis of the measured result.

According to the present invention, it is possible to accurately and quickly install a submerged entry nozzle at a centering position, using an apparatus for centering a submerged entry nozzle in continuous casting. Accordingly, it is possible to minimize channelling of molten steel and expect to improve the quality of a slab by improving stability in the initial solidification.

Further, reducing the channelling phenomenon of the molten steel reduces level changes of the molten steel, such that it is possible to ensure operational safety and perform the most efficient manufacturing, thereby improving manufacturing efficiency.

In particular, since the apparatus for centering a submerged entry nozzle performs the centering in real time while measuring position changes of the submerged entry nozzle even in continuous casting, it is possible to maintain the submerged entry nozzle that has been centered and minimize the channelling phenomenon of the molten steel.

EMBODIMENTS OF THE INVENTION

A preferred embodiment of an apparatus for centering a submerged entry nozzle according to the present invention is described hereafter in detail with the accompanying drawings.

Figure 1:
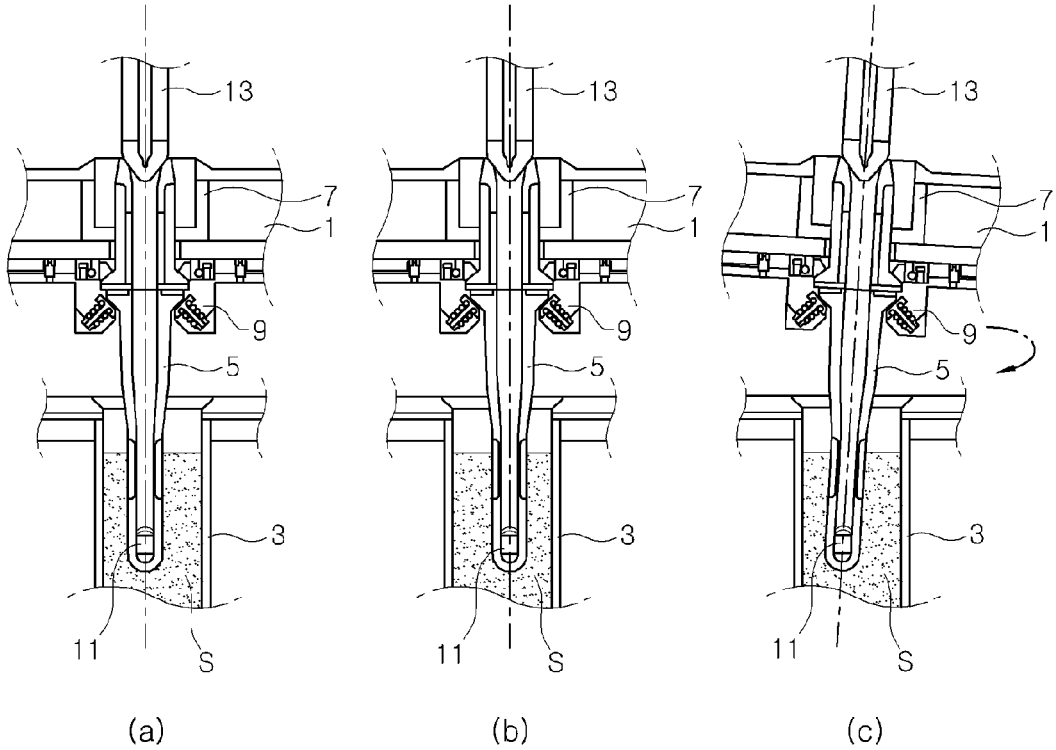
FIG. 1 is a cross-sectional view illustrating an example of incorrect centering position of a submerged entry nozzle that is inserted down in a mold.
Figure 2:
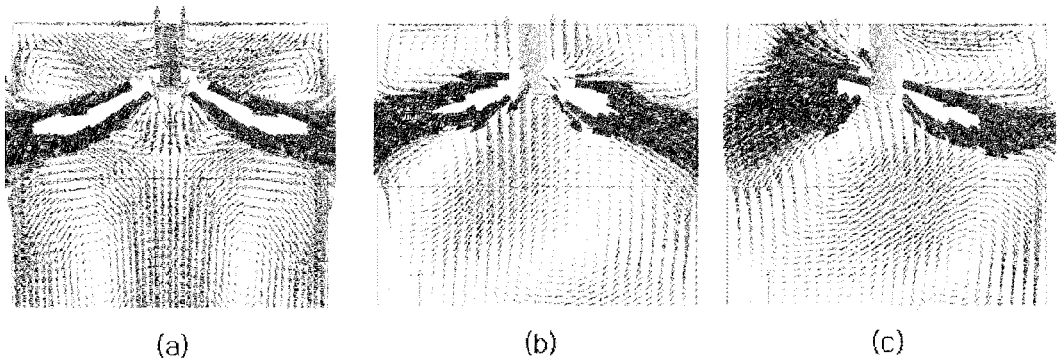
FIG. 2 shows graphs illustrating results of a numerical analysis of normal or abnormal channelling phenomenon of molten steel according to the installation position of a submerged entry nozzle.
Figure 3:
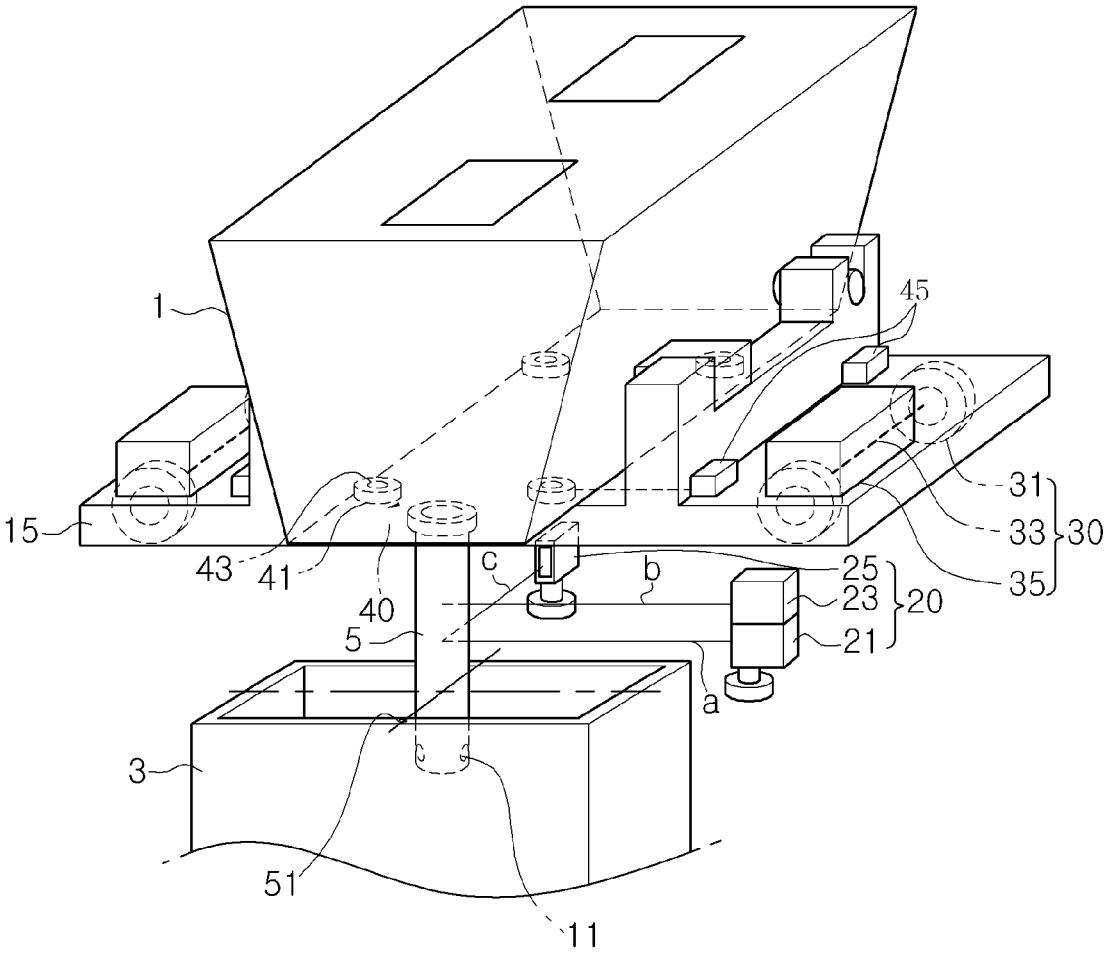
FIG. 3 is a perspective view showing a configuration of a preferred embodiment of an apparatus for centering a submerged entry nozzle according to the present invention.

FIG. 3 is a perspective view showing a configuration of a preferred embodiment of an apparatus for centering a submerged entry nozzle according to the present invention. The same configurations as the related art are indicated by the reference numerals shown in FIG. 1.

Before describing the embodiment below, it is noted that a submerged entry nozzle 5 is connected to the bottom of a tundish 1 using a nozzle connector 9 and is inserted into a mold 3 disposed under the tundish 1 to inject molten steel from the tundish 1 into the mold 3. Further, two molten steel discharge holes 11 are opposingly formed at a lower portion of the submerged entry nozzle 5, such that the molten steel in the tundish 1 is supplied into the mold 3, in which the submerged entry nozzle 5 is centered to prevent a channelling phenomenon of the molten steel.

The detailed configuration of the apparatus for centering a submerged entry nozzle according to the present invention is described hereafter.

The apparatus for centering a submerged entry nozzle (hereafter referred to as a "centering apparatus") includes a plurality of laser beam generators 20, a tundish moving unit, and a control unit, and performs a centering operation in a modulated status.

The laser beam generator 20 is disposed at a level above the mold 3. In detail, the laser beam generator 20 is disposed close to the center in the long side and short side directions above the mold 3 to radiate a laser beam to the center of the mold 3.

The laser beam generator 20 is made of a material that can stand against high-temperature heat of the molten steel and positioned at a predetermined distance from the long side or the short side above the mold 3 for a more safe and accurate measurement.

The laser beam generator 20 includes a first laser beam generator 21, a second laser beam generator 23, and a third laser beam generator 25.

Referring to FIG. 3, the first laser beam generator 21 and the second laser beam generator 23 are aligned in the vertical direction at a level above the mold 3 and to radiate parallel laser beams that are apart from each other in the vertical direction to the perpendicular axis passing through the center of the mold 3.

Further, the third laser beam generator 25 is disposed at a level above the mold 3 and radiates a laser beam that can intersect one of the laser beams radiated from the first laser beam generator 21 and the second laser beam generator 23.

In detail, the first laser beam generator 21 and the second laser beam generator 23 are disposed close to the center of the short side of the mold 3 at levels above the mold 3 and are used to measure the position of the submerged entry nozzle 5 with respect to the short sides of the mold 3 and the perpendicularity of the submerged entry nozzle 5.

Further, the third laser beam generator 25 is disposed close to the center of the long sides of the mold 3 at a level above the mold 3 and is used to measure the centering position of the submerged entry nozzle 5 with respect to the long sides. In this configuration, the first laser beam generator 21 and the second laser beam generator 23 are disposed up and down relationship with each other.

Each of the first laser beam generator 21, the second laser beam generator 23, and the third laser beam generator 25 has at least one laser beam generating means (not shown) that generates a laser beam. This is for measuring whether the submerged entry nozzle 5 is eccentric, using the laser beam radiated to the outer circumference of the submerged entry nozzle 5.

The first laser beam generator 21 measures the installation position of the submerged entry nozzle 5 relative to the short sides and the second laser beam generator 23 measures the perpendicularity of the submerged entry nozzle 5. Further, the third laser beam generator 25 measures the installation position of the submerged entry nozzle 5 relative to the long sides.

The installation position of the submerged entry nozzle 5 is found by comparing the length of the laser beam radiated from the first laser beam generator 21 with a predetermined value and by comparing the length of the third laser beam generator 25 with a predetermined value. Further, the deviation degree of the installation position of the submerged entry nozzle 5 from the centering position is represented by X, Y, and Z coordinates.

When the installation position of the submerged entry nozzle 5 deviates from the centering position of the mold 3 in its short side, there is a difference between a predetermined value and the length (a) of the laser beam between the first laser beam generator 21 and the submerged entry nozzle 5. Further, when the installation position of the submerged entry nozzle 5 deviates from the centering position, there is a difference between a predetermined value and the length (c) of the laser beam between the third laser beam generator 25 and the submerged entry nozzle 5. Here, in which the predetermined value is the center value of the mold 3 centered.

On the other hand, when the submerged entry nozzle 5 is tilted at an angle or rotated about an axis, even if the installation position of the submerged entry nozzle 5 corresponds with the centering position with respect to the long sides or the short sides, the length (a) of the laser beam radiated from the first laser beam generator 21 differs from the length (b) of the laser beam radiated from the second laser beam generator 23 beyond a range of tolerance.

The tundish moving unit is provided to move the tundish 1 above the mold 3. The tundish moving unit has a car body 15 where the tundish 1 is seated, a car actuating mechanism 30, and a plurality of lifters 40.

The car actuating mechanism 30 is provided to center the submerged entry nozzle 5 connected to the lower portion of the tundish 1 with respect to the short sides and the long sides. The car actuating mechanism 30 is disposed at both sides of the tundish moving unit 15 and horizontally moves the tundish 1 above the mold 3.

The car actuating mechanism 30 includes an actuator 31 for horizontally moving the tundish moving unit 15, driving wheels 33 that transmit power to the actuator 31, and a car actuating mechanism-operating unit 35 that transmits power to the driving wheels 33.

For example, the actuator 31 may be a driven gear of which the velocity can be controlled. The driven gear is engaged with a gear (not shown) and horizontally moves the tundish moving unit 15. Further, the actuator 31 can operate at low velocity where it can adjust fine centering deflection of the submerged entry nozzle 5.

The lifters 40 are provided to maintain the perpendicularity of the submerged entry nozzle 5 (that is, maintain the submerged entry nozzle not to be eccentric to any one side). The lifters 40 are disposed on the car body 15 and are configured to adjust the inclination of the seated tundish 1.

The lifters 40 are positioned on the tundish moving unit 15, corresponding to four corners of the bottom of the tundish 1. The lifter 40 has a seating protrusion 41 that protrudes upward from the car body 15 and an adjusting protrusion 43 that is movable up/down on the seating protrusion 41 and supports the lower portion of the tundish 1 with the upper end.

Four lifters 40 are provided in the present embodiment and the centering position of the submerged entry nozzle 5 is accurately adjusted by selectively moving up/down the control protrusions 43 of the four lifters 41 with respect to the seating protrusions 41. While the present embodiment uses four lifters 40, the present invention is not limited to the number. In this configuration, the adjusting protrusions 43 are moved up/down by hydraulic pressure or pneumatic pressure. Here, reference numeral '45' designates a lifter operating means that provides power for moving up/down the adjusting protrusion 43 of the lifter 40.

A centering control unit 50 controls the operation of the tundish moving unit 15 in response to a signal transmitted from the laser beam generator 20 while being linked with the laser beam generator 20.

In detail, the centering control unit 50 measures the lengths of a plurality of laser beams radiated from the laser beam generator 20 and selectively drives any one of the car actuating mechanism 30 and the lifters 40 in accordance with the measurements.

That is, the centering control unit 50 measures the lengths (a, b, c) of the laser beams radiated from the laser beam generator 20, calculates the deviation of the installation position of the submerged entry nozzle 5 from the centering position using the measured lengths (a, b, c) of the laser beams and determines the compensation amounts (X, Y, Z) at that time. Thereafter, it centers the installation position of the submerged entry nozzle 5 by operating the car actuating mechanism 30 and the lifters 40 as much as the compensated amounts.

For example, where there is a deflection above a predetermined value between the average of the lengths (a,b) of the laser beams radiated from the first and second laser beam generators 21 and 23 and a predetermined long side center value of the long sides of the mold 3, the centering control unit 50 moves the car actuating mechanism 30 such that the deflection between the long side center value of the mold and the measured value is minimized.

The centering of the submerged entry nozzle 5 is performed even while the molten steel in the tundish 1 is being flowed into the mold 3. Since the operation of the car actuating mechanism 30 and the lifters 40 for centering the submerged entry nozzle 5 is slowly performed, it should be understood that centering of the submerged entry nozzle would not cause the channelling phenomenon of the molten steel.

On the other hand, an indicator 51 protruding upward is provided at the center of one of the long sides of the mold 3. The indicator 51 is a reference for accurately centering the submerged entry nozzle 5 when the submerged entry nozzle 5 starts to enter the mold 3. While one indicator 51 is provided in this embodiment, the present embodiment is not limited thereto.

The operation of an apparatus for centering a submerged entry nozzle having the above configuration according to an embodiment of the present invention is described hereafter in detail.

Figure 4:
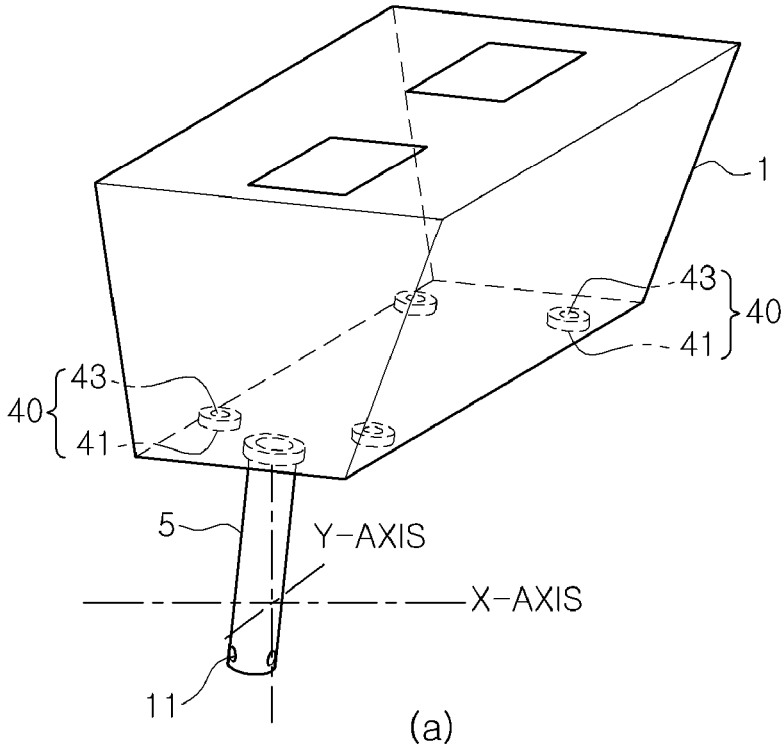
FIG. 4 is a view illustrating the operation of centering a submerged entry nozzle, using an apparatus for centering a submerged entry nozzle according to the present invention.
Figure 4:
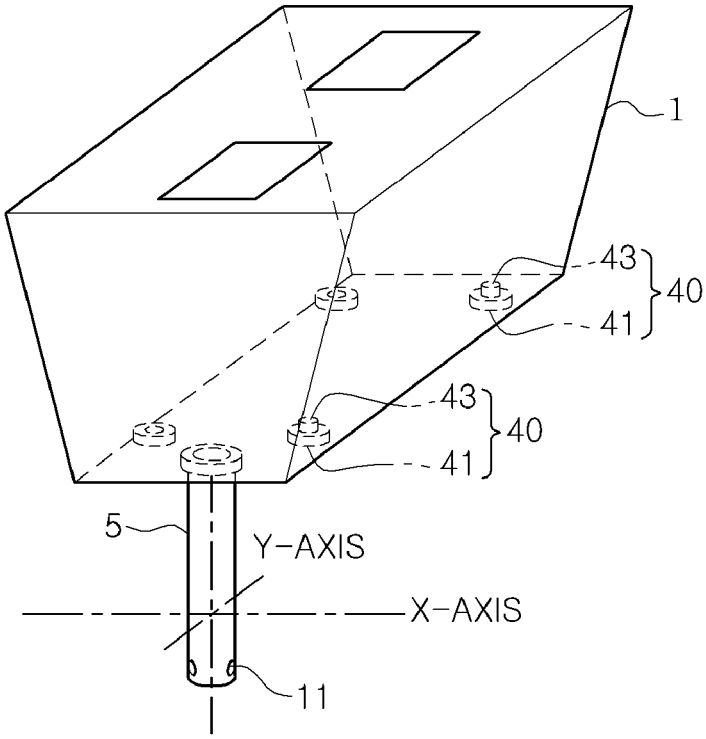
Figure 5:
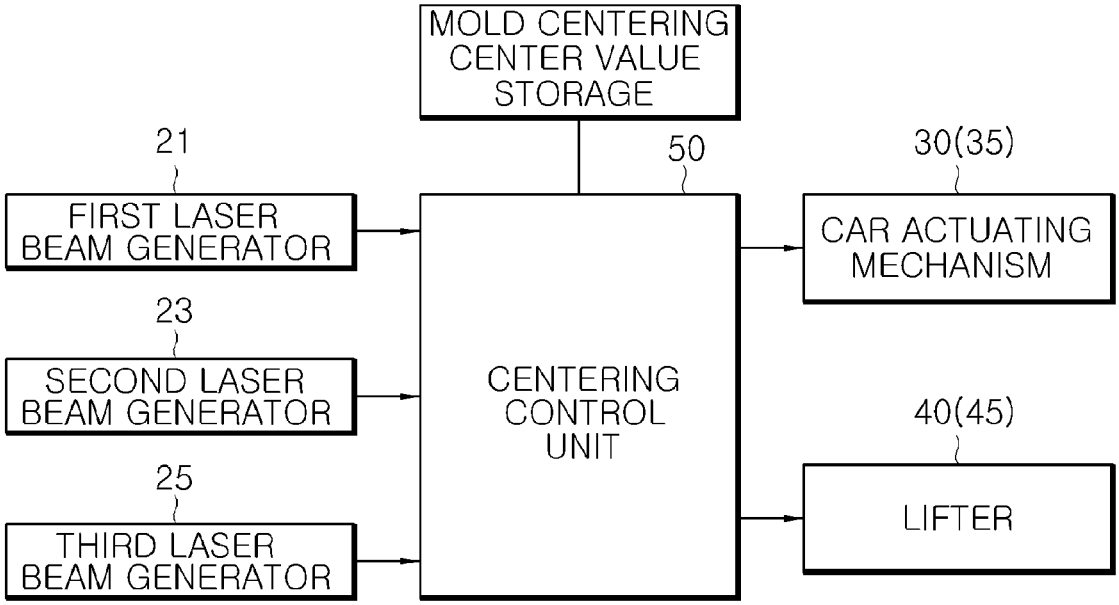
FIG. 5 is a block diagram illustrating a method of centering a submerged entry nozzle, using an apparatus for centering a submerged entry nozzle according to the present invention.

FIG. 4 is a view illustrating the operation of centering a submerged entry nozzle, using an apparatus for centering a submerged entry nozzle and FIG. 5 is a block diagram illustrating a method of centering a submerged entry nozzle, using an apparatus for centering a submerged entry nozzle.

The submerged entry nozzle 5 may be biased to one side when the tundish 1 is set above the mold 3 or the tundish 1 is deformed by heat due to long-time use. That is, when the submerged entry nozzle 5 is off-centered from the long side center or the short side center of the mold 3 by inaccurate installation of the submerged entry nozzle 5 or thermal expansion and contraction of the tundish 1, the submerged entry nozzle 5 can be centered to compensate the off-centering. The operation of centering the submerged entry nozzle 5 can be performed even while the submerged entry nozzle 5 is entering into the mold 3 or while the molten steel is being flown into the mold 3.

The operation of centering the submerged entry nozzle is as follows.

First, as the laser beam generator 20 radiates laser beams toward the center of the mold 3, the laser beams are radiated to the outer circumference of the submerged entry nozzle 5, and then the centering control unit 50 receives data from the laser beam generator 20 and measures the lengths (a, b, c) of the laser beams.

The centering control unit 50 calculates the installation position of the submerged entry nozzle 5 with respect to the long sides and the short sides and whether it is biased, by comparing the lengths (a, b, c) of the laser beams with predetermined data.

Further, the centering control unit determines that the submerged entry nozzle 5 is deviated from the centering position and determines the compensation values, when there is a difference between the calculated values and the predetermined value, and then it operates the car actuating mechanism 30 and the lifters 40 as much as the compensated values such that the installation position of the submerged entry nozzle 5 agrees with a predetermined centering position.

That is, when there is a difference beyond a predetermined value between the long side center value of the mold 3 and the average of the lengths of the laser beams radiated from the first and second laser beam generators 21 and 23, the centering control unit 50 adjusts the installation position of the submerged entry nozzle 5 by horizontally moving the car actuating mechanism 30.

Further, when there is a difference beyond a predetermined value between the length of the laser beam radiated from the third laser beam generator 25 and the predetermined short side center value, the centering control unit 50 adjusts the installation position of the submerged entry nozzle 5 such that the length becomes close to the center value by selectively moving up/down the adjusting protrusions 43 of the lifters 40.

For example, as shown in FIG. 4A, when the submerged entry nozzle 5 is biased to the left of the long sides of the mold 3, the lifters 40 are operated to adjust it. That is, as shown in FIG. 4B, two adjusting protrusions 43 are moved up such that the installation position of the submerged entry nozzle 5 agrees with the centering position.

The present invention may be modified in various ways by those skilled in the art within the technical scope of the present invention, and the scope of the present invention should be construed on the basis of the accompanying claims.

The invention claimed is:

1. An apparatus for centering a submerged entry nozzle, the apparatus comprising:

a plurality of laser beam generators, each of which is disposed at a level above a mold for continuous casting and is configured to radiate a laser beam;

a tundish moving unit configured to move a tundish above the mold; and a control unit that is connected to the laser beam generators and is configured to control the tundish moving unit to center the submerged entry nozzle provided at a lower portion of the tundish, in response to signals transmitted from the laser beam generators.

2. The apparatus for centering a submerged entry nozzle according to claim 1, wherein the laser beam generator includes:

a first laser beam generator and a second laser beam generator that are disposed apart from each other in an up-down direction above the mold and configured to radiate parallel laser beams toward a vertical axis passing through the center of the mold; and a third laser beam generator that is disposed at a level above the mold and configured to radiate a laser beam in a direction that intersects the laser beam radiated from one of the first laser beam generator and the second laser beam generator.

3. The apparatus for centering a submerged entry nozzle according to claim 2, wherein the tundish moving unit includes:

a car body on which the tundish is seated;

a car actuating mechanism provided at two opposing sides of the car body and configured to horizontally move the tundish above the mold; and a plurality of lifters, each of which is disposed on the car body and configured to adjust inclination of the seated tundish while supporting the tundish.

4. The apparatus for centering a submerged entry nozzle according to claim 3, wherein the lifter has a seating protrusion that protrudes above the car body and an adjusting protrusion that can be moved up/down on the seating protrusion and supports the lower portion of the tundish.

5. The apparatus for centering a submerged entry nozzle according to claim 3, wherein the control unit measures a length of a laser beam from each of the laser beam generators and selectively drives any one of the car actuating mechanism and the lifter based on the measurements.

6. The apparatus for centering a submerged entry nozzle according to claim 3, wherein the control unit measures a length of a laser beam from each of the laser beam generators and drives the car actuating mechanism and the lifter based on the measurements.

7. An apparatus for continuous casting of a metal slab, the apparatus comprising:

a tundish configured to contain molten metal;

a continuous casting mold located below the tundish;

a nozzle connected to the tundish and configured to flow the molten metal from the tundish into the mold;

a first laser beam generator configured to radiate a first laser beam on a horizontal plane to a first circumferential point of the nozzle;

a tundish mover configured to move the tundish; and a controller configured to control the tundish mover to move the tundish relative to mold based on a first difference between a predetermined value and a first length of the first laser beam from the first laser beam generator to the first circumferential point of the nozzle, whereby moving of the tundish is to adjust centering of the nozzle within the mold.

8. The apparatus of claim 7, further comprising:

a second laser beam generator configured to radiate a second laser beam in a direction parallel to the first laser beam to a second circumferential point of the nozzle, wherein the first and second laser beam generators are aligned in an axis perpendicular to the horizontal plane, wherein the controller is further configured to control the tundish mover to move the tundish relative to mold based on a second difference between the first length and a second length of the second laser beam from the second laser beam generator to the second circumferential point of the nozzle.

9. The apparatus of claim 7, wherein the tundish mover comprises a horizontal moving mechanism configured to move the tundish in a direction on the horizontal plane, wherein the controller is configured to determine a distance of horizontal movement of the tundish in the direction based on the first difference.

10. The apparatus of claim 7, wherein the tundish mover comprises a tilting mechanism configured to tilt the tundish, wherein the controller is configured to determine an amount of tilting of the tundish by the tilting mechanism based on the first difference.

11. A method of continuous casting of a metal slab, the method comprising:

providing an apparatus comprising a tundish containing molten metal, a continuous casting mold located below the tundish, a nozzle connected to the tundish and having a tip portion entering into a space defined by the mold, a first laser beam generator located at a level beyond the mold, and a tundish mover configured to move the tundish;

continuously flowing the molten metal from the tundish into the mold;

causing the first laser beam generator to radiate a first laser beam on a horizontal plane to a first circumferential point of the nozzle;

measuring a first length of the first laser beam from the first laser beam generator to the first circumferential point of the nozzle; and comparing the first length with a predetermined value;

causing the tundish mover to move the tundish relative to mold based on a first difference between the first length and the predetermined value so as to adjust centering of the tip portion of the nozzle within the mold.

12. The method of claim 11, wherein the apparatus further comprises a second laser beam generator that is aligned in an axis perpendicular to the horizontal plane, the method further comprising:

causing the second laser beam generator to radiate a second laser beam in a direction parallel to the first laser beam to a second circumferential point of the nozzle;

comparing the first length with a second length of the second laser beam from the second laser beam generator to the second circumferential point of the nozzle; and causing the tundish mover to move the tundish relative to mold based on a second difference between the first length and the second length so as to further adjust centering of the tip portion of the nozzle within the mold.

13. The method of claim 11, wherein the tundish mover comprises a horizontal moving mechanism configured to move the tundish in a direction on the horizontal plane, wherein the method further comprises determining a distance of horizontal movement of the tundish in the direction based on the first difference.

14. The method of claim 11, wherein the tundish mover comprises a tilting mechanism configured to tilt the tundish, wherein the method further comprises determining an amount of tilting of the tundish by the tilting mechanism based on the first difference.

* * * * *